US006932426B2

(12) United States Patent
Greger

(10) Patent No.: US 6,932,426 B2
(45) Date of Patent: Aug. 23, 2005

(54) TRAY SYSTEM FOR A SEAT APPARATUS

(75) Inventor: Jeff G. Greger, Lititz, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/127,674

(22) Filed: Apr. 23, 2002

(65) Prior Publication Data

US 2003/0197403 A1 Oct. 23, 2003

(51) Int. Cl.[7] ..... A47B 1/00
(52) U.S. Cl. ..... 297/149; 297/150
(58) Field of Search ..... 297/148, 149, 297/150, 151, 153, 145, 161, 162; 108/90, 93, 143

(56) References Cited

U.S. PATENT DOCUMENTS

| | | | | |
|---|---|---|---|---|
| 2,210,972 A | | 8/1940 | Christenson | |
| 2,281,813 A | | 5/1942 | Uline | |
| 2,430,682 A | | 11/1947 | Merkle | |
| 2,672,182 A | | 3/1954 | Gwin et al. | |
| 2,701,006 A | | 2/1955 | Kandarian | |
| 3,095,236 A | | 6/1963 | Klassen | |
| 3,146,738 A | | 9/1964 | Telarico | |
| 3,215,467 A | | 11/1965 | McFarland et al. | |
| 3,784,142 A | | 1/1974 | O'Brien | |
| 4,063,701 A | | 12/1977 | Wray | |
| 4,099,470 A | | 7/1978 | Cannon, Jr. | |
| 4,165,123 A | | 8/1979 | Hutson | |
| 4,262,962 A | | 4/1981 | Yust | |
| 4,384,532 A | | 5/1983 | Staff | |
| 4,582,359 A | | 4/1986 | Wise et al. | |
| 4,600,255 A | * | 7/1986 | Dubarko | 108/143 X |
| 4,606,576 A | | 8/1986 | Jones | |
| 4,659,099 A | * | 4/1987 | Malone | 297/153 |
| 4,715,295 A | | 12/1987 | Hartman et al. | |
| 4,779,884 A | | 10/1988 | Minati | |
| 4,798,413 A | | 1/1989 | Capelli | |
| 4,852,499 A | | 8/1989 | Ozols | |
| 4,927,024 A | | 5/1990 | Lloyd | |
| 4,953,771 A | | 9/1990 | Fischer et al. | |
| 4,955,571 A | | 9/1990 | Lorence et al. | |

(Continued)

FOREIGN PATENT DOCUMENTS

| | | |
|---|---|---|
| DE | 42 27 064 A1 | 10/1993 |
| FR | 2 758 506 A1 | 7/1998 |
| GB | 639 528 | 6/1950 |
| GB | 2 206 488 A | 1/1989 |
| JP | 4-90936 A | 3/1992 |
| JP | 2000-168423 A | 6/2000 |
| JP | 2001-260732 A | 9/2001 |

*Primary Examiner*—Anthony D. Barfield
(74) *Attorney, Agent, or Firm*—Foley & Lardner LLP

(57) ABSTRACT

A tray system for a seat apparatus comprising a first body configured as a tray and coupled to the seat apparatus. A second body having a top side is movably coupled to the bottom side of the first body. The second body moves to a position under at least a portion of the first body. Another embodiment provides that the second body includes a plurality of guide tracks configured to engage a corresponding plurality of guide members coupled to the bottom side of the first body. The second body can translate along the tracks to a position under at least a portion of the first body.

8 Claims, 4 Drawing Sheets

U.S. PATENT DOCUMENTS 4,968,092 A 11/1990 Giambrone
5,010,826 A 4/1991 Kudlac
5,060,899 A 10/1991 Lorence et al.
5,087,097 A 2/1992 Hehn
5,100,001 A 3/1992 Brooks
5,118,161 A 6/1992 Slowe et al.
5,156,367 A 10/1992 Wolfe
5,211,607 A 5/1993 Fermaglish et al.
5,238,292 A 8/1993 Golenz et al.
5,259,580 A 11/1993 Anderson et al.
5,295,650 A 3/1994 Brandt
5,330,146 A 7/1994 Spykerman
5,348,374 A 9/1994 Kuo
5,383,586 A 1/1995 Leivan
D358,730 S 5/1995 Meeker et al.
5,473,997 A 12/1995 Solomon et al.
5,489,138 A 2/1996 Mariol et al.
5,507,550 A 4/1996 Maloney
5,524,958 A 6/1996 Wieczorek et al.
5,527,090 A 6/1996 Cone, II
5,558,391 A 9/1996 Chavous
5,562,049 A * 10/1996 Hoffman et al. ..... 297/145 X
5,586,800 A 12/1996 Triplett
5,586,804 A 12/1996 Burroughs
5,588,697 A 12/1996 Yoshida et al.
5,597,148 A 1/1997 Gospodarich
5,649,737 A 7/1997 Behnke
5,692,815 A 12/1997 Murphy
5,810,432 A 9/1998 Haut et al.
5,820,207 A 10/1998 Wang
5,876,007 A 3/1999 Lancaster et al.
5,951,102 A 9/1999 Poulson et al.
5,992,932 A 11/1999 Kain et al.
6,024,412 A 2/2000 Kain et al.
6,062,640 A 5/2000 Stahl
D426,965 S 6/2000 Wu
D427,822 S 7/2000 Greger
6,119,996 A 9/2000 Connery
6,126,236 A 10/2000 Wu
D435,196 S 12/2000 Gregor et al.
6,227,511 B1 5/2001 De Costa
6,247,750 B1 6/2001 Tsai
6,283,042 B1 9/2001 Wargo et al.
6,293,623 B1 9/2001 Kain et al.
6,298,793 B1 10/2001 Turner et al.
6,302,033 B1 10/2001 Roudebush
6,419,312 B1 7/2002 Edwards et al.
2002/0036416 A1 3/2002 Mendenhall et al.

* cited by examiner

TRAY SYSTEM FOR A SEAT APPARATUS

BACKGROUND OF THE INVENTION

This invention relates to a tray system for a seat apparatus and more particularly to an auxiliary tray for use with a high chair.

Conventional high chairs typically have a tray mounted to the arms or similar structure of the high chair. At times, additional space on the tray is needed to accommodate the food stuff of a care giver of the person sitting in the high chair.

To address the need for additional space secondary trays are used with the primary tray of the high chair. Such secondary trays typically are clamped onto an edge of the primary tray, or mounted on an arm or leg of the high chair. Such secondary trays are usually smaller than the primary tray. Other secondary trays are mounted over the primary tray. In such instance, the secondary tray can be larger than the primary tray. In any of the above described schemes, the secondary tray is not hidden from view when not in use and, in some instances, must be stored separate from the high chair.

Thus there is a need for an auxiliary tray for use with a high chair that can be hidden from view when not in use. There is a further need for an auxiliary tray that can be stored with the high chair.

SUMMARY OF THE INVENTION

There is provided a tray system for a seat apparatus comprising a first body configured as a tray having a bottom side and coupled to the seat apparatus and a second body movably coupled to the bottom side of the first body. The second body moves under at least a portion of the first body. Another embodiment provides that the second body includes a plurality of guide tracks configured to engage a corresponding plurality of guide members coupled to the bottom side of the first body. The second body can translate along the tracks under the first body.

There is also provided a high chair comprising a seat structure mounted on a plurality of legs with a first tray having a bottom side coupled to the seat structure and auxiliary tray. The auxiliary tray includes a body with a track coupled to the body. The first tray includes a guide member configured to engage with the track and coupled to the bottom side of the first tray. The body can translate along the track to a position under at least a portion of the first tray.

There is further provided an auxiliary tray for use with a high chair having a first tray. The first tray has a bottom side. The auxiliary tray comprises a body with a track coupled to the body. The track is configured to engage a guide member and coupled to the bottom side of the first tray. The body can translate along the track to a position under at least a portion of the first tray. An additional embodiment includes a second track coupled to the body a spaced distance from the other track and configured to engage a second guide member and coupled to the bottom side of the first tray. A further embodiment provides that the body is removably coupled to the first tray.

DETAILED DESCRIPTION OF THE EXEMPLARY EMBODIMENTS

Figure 6:
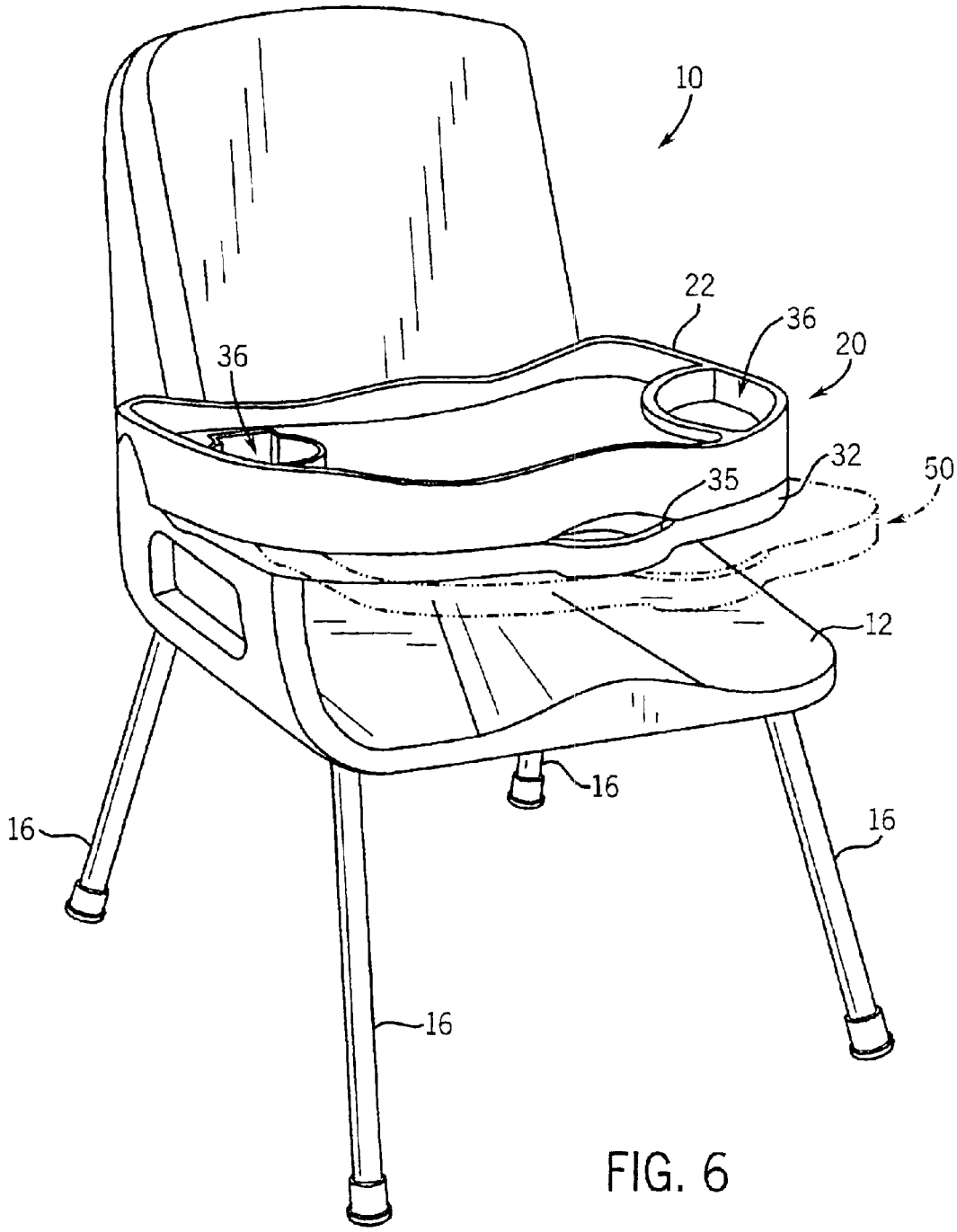
FIG. 6 is a perspective view of another seat apparatus having an exemplary embodiment of a tray system.

Before describing several exemplary embodiments of a tray system for a seat apparatus in accordance with the invention, there are several general comments. The tray system 20 can be utilized with any type of seat apparatus 10. The drawings illustrate two types of seat apparatus, namely a high chair 14 (see FIG. 1) and a more conventional chair (see FIG. 6). The high chair is typically used for an infant or toddler; however, it is contemplated that the scale of the chair would be appropriate for the size of person sitting in such seat apparatus. For instance, an adult would be seated in such a chair for use in a hospital or a nursing home or any other type of extended care facility, including a residence.

The first and second trays 22, 32 typically are constructed from the same type of material. For example, the trays can be from steel or aluminum which is fabricated by stamping, or plastic which is fabricated by a molding process such as blow molding, injection molding, or vacuum molding or the like or wood. It is also contemplated that the first and second trays 22, 32 can be of dissimilar materials such as plastic with steel, plastic with wood, etc. The aesthetics of the tray system and the fabricating processes are determined by the manufacturer of such tray system.

Figure 1:
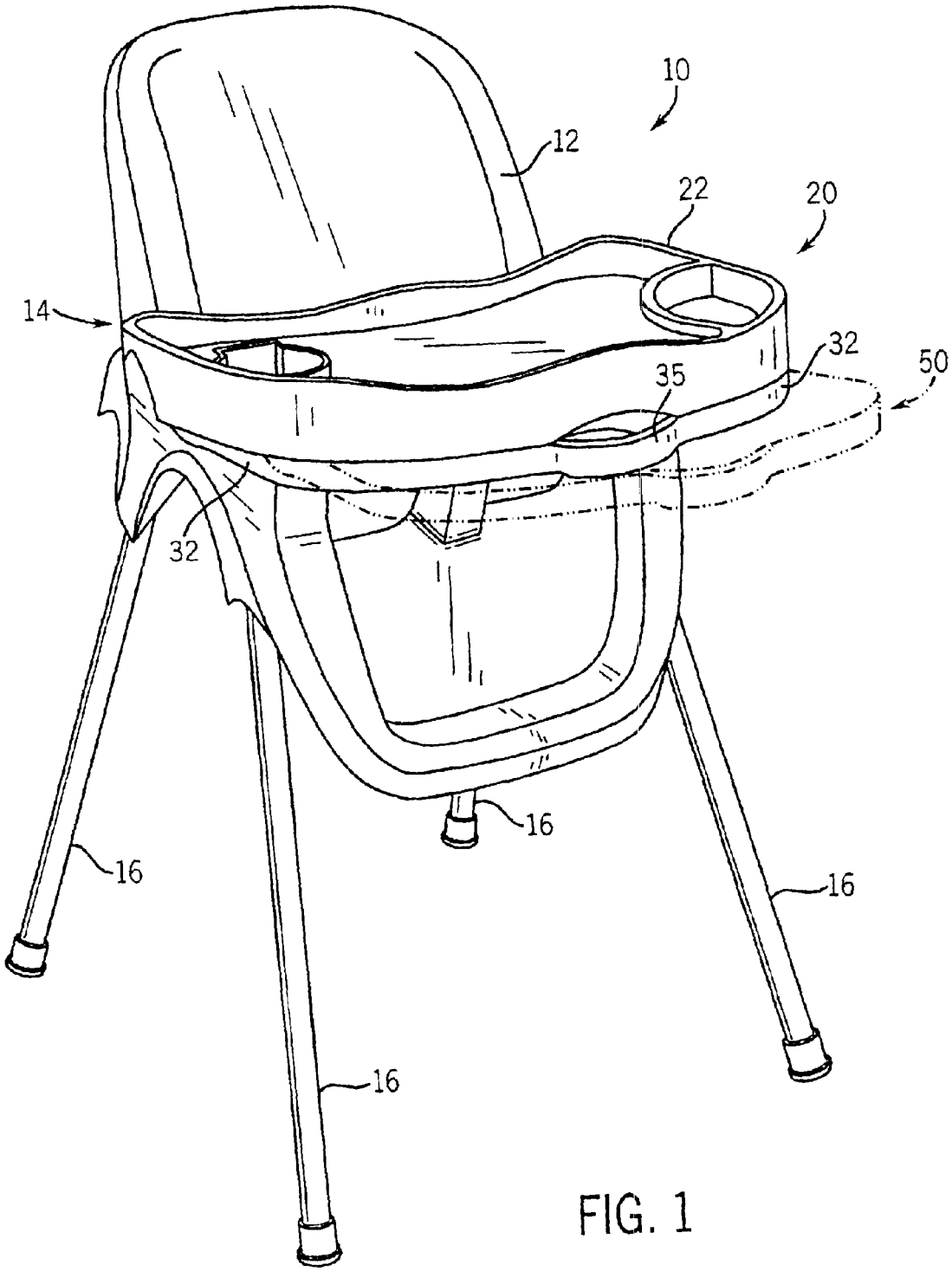
FIG. 1 is a perspective view of a high chair type seat apparatus having an exemplary embodiment of a tray system in a closed position and a dotted line illustration of the tray system in an open position.
Figure 2:
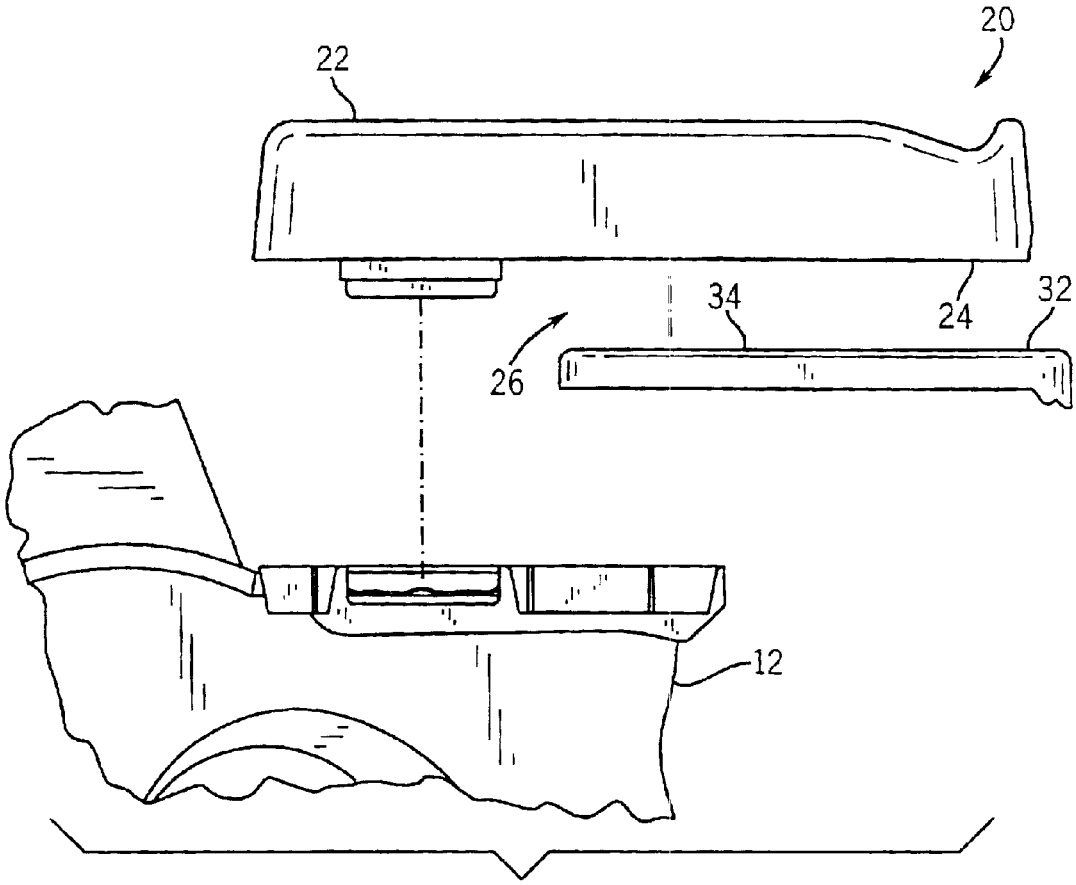
FIG. 2 is a partial exploded view of the tray system illustrated in FIG. 1.

Referring now to the Figures, FIG. 1 illustrates a perspective view of a high chair type 14 seat apparatus 10 having an exemplary embodiment of a tray system 20. The tray system comprises a first body 22 configured as a first tray and having a bottom side 24. The first body 22 is coupled to the seat apparatus 10 by any convenient and conventional coupling mechanism. The tray system 20 also includes a second body 32, or auxiliary tray, having a top side 34. The second body 32 is movably coupled to the bottom side 24 of the first body 22 so that the second body 32 can move under at least a portion 26 of the first body 22. FIG. 1 illustrates the second body 32 in a closed position (solid lines) and an open position (dotted lines). FIG. 1 also illustrates a high chair type 14 seat structure 12, mounted on a plurality of legs 16. The tray system 20 described above is coupled to the seat structure 12.

The second body 32 of the tray system 20 can include one or more guide tracks 38, 42 configured to engage corresponding one or more guide members 44 coupled to the bottom side 24 of the first body 22. The guide tracks 38, 42 can be formed in the sides of the second body 32, or the guide tracks can partially extend into the second body. The second body 32 can translate along the tracks 38, 42 under at least a portion 26 of the first body 22. The second track 42 is a spaced distance from the other track 38. Additional tracks and guide members can be provided to add additional stability to the tray system 20.

The guide tracks 38, 42 can be configured as elongated slots 40 or they can be molded in the second body 32. The guide tracks 38, 42 also can be separate members attached to the second body 32 with a fastener or an adhesive. The guide members 44, 46 can be molded on the first body 22, or they can be secured to the bottom side 24 of the first body 22. For example, the guide members 44, 46 can be screws turned into the bottom side 24 of the first body 22, or they can be bolts, pegs or such other devices that will engage a corresponding guide track 38, 42 to allow the second body 32 to translate along the tracks under the first body 22. It should be appreciated that the guide tracks 38, 42 can be coupled to the bottom side 24 of the first body 22 and the guide member 44, 46 coupled to the second body 32 to effect a similar arrangement and function of the tray system 20. Such couplings can be by any of the methods described above.

Figure 4:
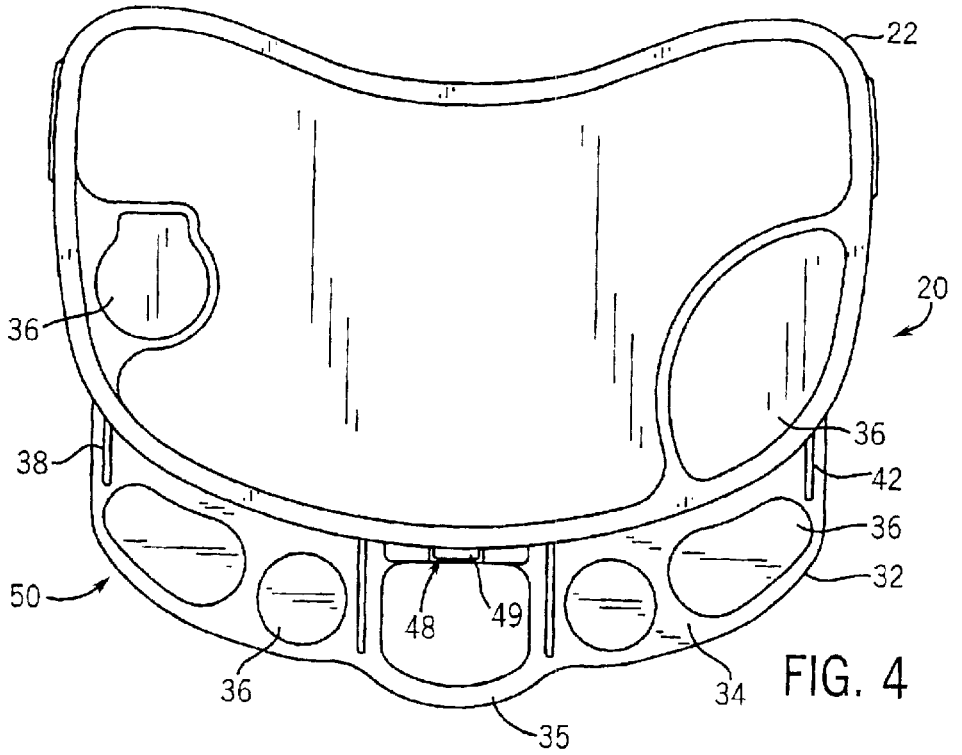
FIG. 4 is a plan view of the top sides of the first body and the second body of the tray system illustrated in FIG. 3.

The second body 32 of the tray system 20 can include a recess 36 for foodstuff, caregiver implements such as tissues, bandages, or other sundries, or the like, as best seen in FIG. 4. More than one recess 36 can be provided in the second body 32, with the recesses configured to different shapes to accommodate, for example, a dish, bowl, glass, or other utensil. In the embodiment of the tray system shown in the figures, the second body 32 is coupled to the first body 22 to translate forward of a front surface of the first body 22. Coupling the second body 32 to translate forward of the first body 22 provides the advantage that, while the second body 32 is in the open position, the second body 32 and associated recess or recesses 36 are out of reach of the person sitting in the seat apparatus 10. In this regard, objects that a child caregiver wants to keep out of reach of a child seated in a high chair 14 can be placed in the recesses 36 of the second body 32.

The second body 32 of the tray system 20 can be removably coupled to the first body 22. The guide track 38, 42 can be configured to allow the second body 32 to disengage from the guide member 44, 46 for cleaning or repair purposes. The second body 32 can be provided with a grip or handle 35 to facilitate its movement from one position to another. However, it should be understood that the typical arrangement of the tray system 20 is to provide for the second body 32 to be stored under the first body 22 when not in use. A seat apparatus 10 of the high chair type 14 with the second body 32 in a closed position is illustrated in FIG. 1.

Figure 5:
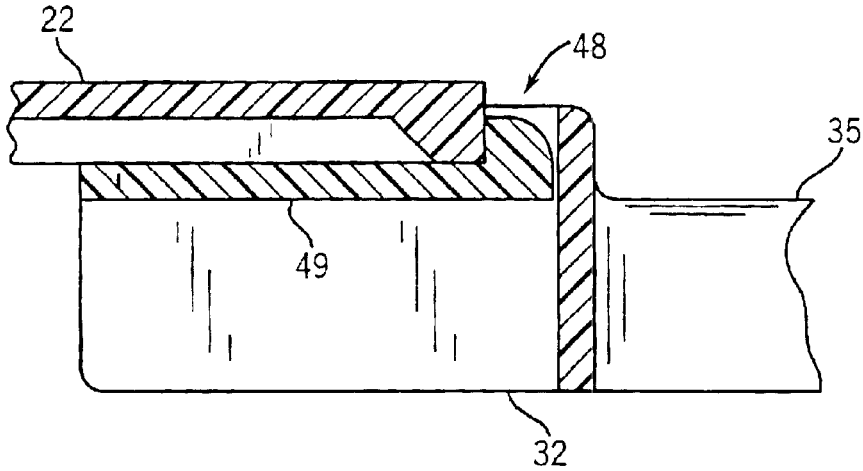
FIG. 5 is a partial cross sectional view of an exemplary embodiment of a lock for the second body of the tray system illustrated in FIG. 3 along the line 5—5.
Figure 3:
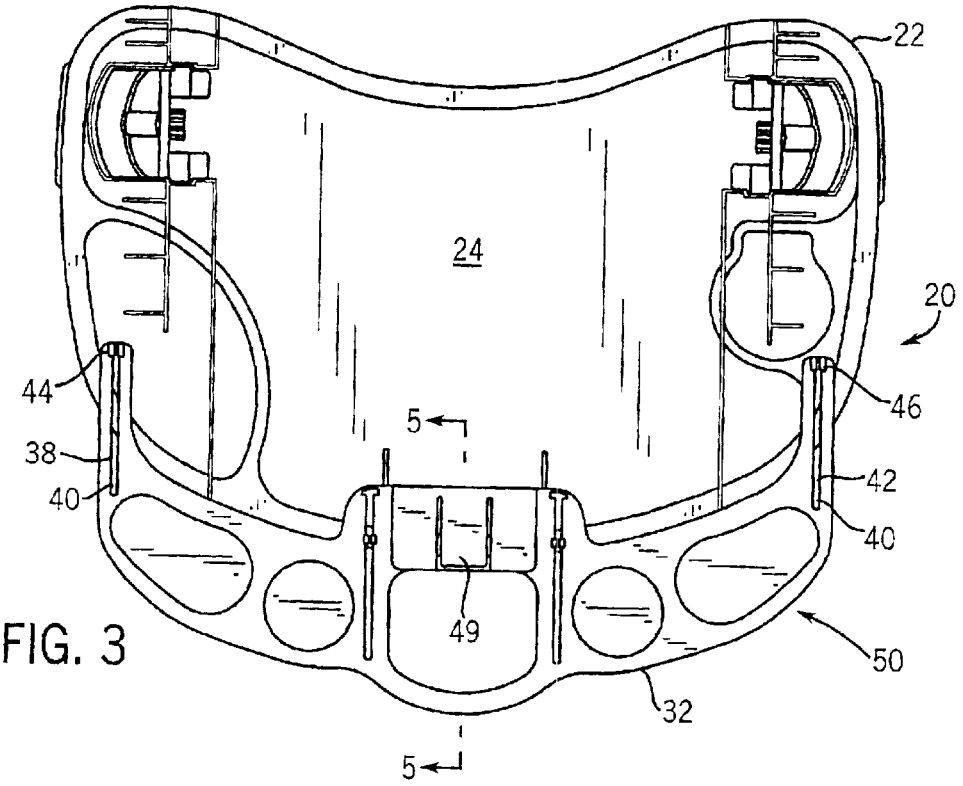
FIG. 3 is a plan view of the bottom sides of a first body and a second body of an exemplary embodiment of a tray system.

FIGS. 3 and 4 depict the second body 32 in an open position 50. The second body 32 can include a lock 48 configured to secure the first body 22 and the second body 32 in a pre-selected position 50. It is contemplated that, in alternative embodiments, the lock 48 can be configured on the first body 22. FIG. 5 illustrates an exemplary embodiment of the lock 48. The lock 48 is shown engaging a portion of the first body 22 to lock the second body 32 in the open position 50. The lock 48 can be a cantilevered, flexible tab 49, as illustrated in FIG. 5, or, alternatively, it can be a biased pin configured to engage a hole or a bore, or it can be a pivoted biased lever or any other convenient and conventional locking mechanism. The lock 48 can be disengaged by pushing downward on the tab 49 to move the tab 49 below the front surface of the first body 22. The second body 32 then can be pushed to a new position, such as the closed position shown in solid lines in FIG. 1. When the second body 32 is moved back to the open position 50, the tab 49 can automatically move upward once past the front surface of the first body 22 to engage the front surface, as shown in FIG. 5. In alternative embodiments, a plurality of pre-selected lock positions can be provided by providing a series of slots or notches in one of the first and second bodies 22, 32 and providing a lock on the other of the first and second bodies 22, 32 to engage or contact the slots or notches.

Thus, there is provided a tray system for a seat apparatus that includes a first body configured as a tray and a second body coupled to the first body, wherein the second body moves under at least a portion of the first body. While the embodiments illustrated in the figures and described above are presently preferred, it should be understood that these embodiments are offered by way of example only. The invention is not intended to be limited to any particular embodiment but is intended to extend to various modifications that nevertheless fall within the scope of the appended claims. For example, in one embodiment, the tray system can be removed completely from the seat structure of the seat apparatus. It is also contemplated, in another embodiment, that the tray system can be pivotally coupled to the seat structure of the seat apparatus so that the tray system can be swung up and over the seat structure or swung around in front of the seat structure. Additional modifications such as those described at the beginning of the description above will be evident to those with ordinary skill in the art.

What is claimed is:

1. A high chair comprising:

a seat structure mounted on a plurality of legs, the seat structure including a seat back and a pair of arms;

a first tray having a bottom side coupled to the seat structure such that the first tray is positionable in front of the seat back and over the pair of arms;

an auxiliary tray, the auxiliary tray including:

a body; and a track coupled to the body, the first tray including a guide member configured to engage with the track and coupled to the bottom side of the first tray, wherein the body can translate along the track between a first position, at which the body extends at least partially out from under the first tray, and a second position, at which the body is substantially hidden from view under at least a portion of the first tray; and a lock configured to secure the body in the first position relative to the first tray.

2. The high chair of claim 1, wherein the body includes a second track at a spaced distance from the other track, and wherein the first tray includes a second guide member configured to engage with the second track and coupled to the bottom side of the first tray.

3. The high chair of claim 2, wherein the tracks are molded with the body.

4. The high chair of claim 2, wherein the guide members are molded on the first tray.

5. The high chair of claim 1, wherein the track is an elongated slot.

6. The high chair of claim 1, wherein the body defines at least one recess.

7. The high chair of claim 1, wherein the body is removably coupled to the first tray.

8. A high chair comprising:

a seat structure mounted on a plurality of legs, the seat structure including a seat back and a pair of arms;

a first body configured as a tray having a bottom side coupled to the seat structure such that the first tray is positionable in front of the seat back and over the pair of arms; and a second body movably coupled to the bottom side of the first body to move between a first position, at which the second body extends at least partially out from under the first body, and a second position, at which the second body is substantially hidden from view under at least a portion of the first body; and a lock configured to secure the second body in the first position relative to the first body.

* * * * *